US008727838B2

(12) United States Patent
Leung et al.

(10) Patent No.: US 8,727,838 B2
(45) Date of Patent: May 20, 2014

(54) AUXILIARY SANDER ATTACHMENT FOR PORTABLE SANDER

(75) Inventors: Hei Shun Leung, Tsuen Wan (HK); Kwok Ting Mok, Tsuen Wan (HK)

(73) Assignee: Techtronic Power Tools Technology Limited, Tortola (VG)

( * ) Notice: Subject to any disclaimer, the term of this patent is extended or adjusted under 35 U.S.C. 154(b) by 263 days.

(21) Appl. No.: 13/170,248

(22) Filed: Jun. 28, 2011

(65) Prior Publication Data

US 2012/0003905 A1 Jan. 5, 2012

(30) Foreign Application Priority Data

Jul. 5, 2010 (EP) ..... 10251206

(51) Int. Cl.
*B24B 23/04* (2006.01)
*B24B 27/00* (2006.01)

(52) U.S. Cl.
CPC ..... *B24B 27/00* (2013.01); *B24B 27/0076* (2013.01); *B24B 23/04* (2013.01)
USPC ..... 451/363; 451/344

(58) Field of Classification Search
CPC ..... B24B 27/00; B24B 27/0076; B24B 23/04
USPC ..... 451/344, 441, 65, 66, 461, 348, 349, 451/350, 351, 352, 353, 356–359
See application file for complete search history.

(56) References Cited

U.S. PATENT DOCUMENTS 2,370,323 A * 2/1945 Patt ..... 451/490
5,056,268 A * 10/1991 Wolff ..... 451/357
5,157,873 A * 10/1992 Rudolf et al. ..... 451/342
5,398,457 A * 3/1995 Updegrave et al. ..... 451/415
5,421,053 A * 6/1995 Chodak ..... 15/87
5,879,227 A * 3/1999 Martin et al. ..... 451/356
5,967,886 A * 10/1999 Wuensch et al. ..... 451/356
6,165,060 A * 12/2000 Martin et al. ..... 451/356
6,186,878 B1 * 2/2001 Takizawa et al. ..... 451/357
6,283,843 B1 * 9/2001 Romagnoli ..... 451/523
6,659,851 B2 * 12/2003 Takahashi et al. ..... 451/356
6,699,114 B1 * 3/2004 Booeshaghi et al. ..... 451/451
6,705,931 B2 * 3/2004 Moolenaar et al. ..... 451/357

(Continued)

FOREIGN PATENT DOCUMENTS

DE 8535865 U1 2/1986
DE 29614325 U1 10/1996
EP 1166963 A1 1/2002

OTHER PUBLICATIONS

European Search Report dated Oct. 26, 2010 for corresponding European Application No. EP10251206.

*Primary Examiner* — Lee D Wilson
*Assistant Examiner* — Tyrone V Hall, Jr.
(74) *Attorney, Agent, or Firm* — Michael Best & Friedrich LLP

(57) ABSTRACT

A sander has two abrasive-supporting base parts mounted to an oscillating drive mechanism. The base parts may support a sandpaper sheet, or the like, and are connected to one another in a manner allowing ready reconfiguration for different applications. One of the base parts is connected by a pivoting coupling to the other for movement between extended and retracted positions. Latching means releasably lock the coupling so as to hold the parts in the extended position.

15 Claims, 7 Drawing Sheets

(56) References Cited

U.S. PATENT DOCUMENTS

| | | | | |
|---|---|---|---|---|
| 6,887,143 | B2 * | 5/2005 | Bocka et al. | 451/359 |
| 7,313,838 | B2 * | 1/2008 | Long et al. | 15/22.2 |
| 7,736,216 | B2 * | 6/2010 | King et al. | 451/357 |
| 8,007,346 | B2 * | 8/2011 | Dehde et al. | 451/344 |
| 2003/0166386 | A1 * | 9/2003 | McDonald | 451/360 |
| 2003/0167585 | A1 * | 9/2003 | Chen | 15/97.1 |
| 2006/0068689 | A1 * | 3/2006 | Kiss et al. | 451/359 |
| 2010/0048109 | A1 * | 2/2010 | King et al. | 451/356 |

* cited by examiner

AUXILIARY SANDER ATTACHMENT FOR PORTABLE SANDER

TECHNICAL FIELD

The present invention relates to sanders, particularly sanders with an abrasive-supporting base comprising at least two parts.

BACKGROUND OF THE INVENTION

Orbital or in-line sanders have a base for supporting an abrasive sheet, or consisting of an abrasive block or pad. This abrasive-supporting base is mounted to a motor-driven oscillating mechanism. The sander may be configured to accept bases of different shapes (e.g. rectangular, triangular or elongate fingers) for differing applications, and typically these bases are mounted by screw fasteners. Providing detachable bases of this kind makes the sander more versatile, however this arrangement is not without some drawbacks. For instance, the replacement operation can be time-consuming and there is a need to carry or store replacement bases, some of which may be small parts that are readily misplaced.

In addition to the entire base being detachable, it is known to provide abrasive-supporting bases made in one or more detachable parts. EP 1 166 963 describes a sander in which different shaped tips may be connected to provide different shaped base assemblies. The detachable tips are releasably connected by hooks that cooperate with a spring-loaded latch, thereby avoiding the need for tools to re-configure the base. However, this design does not otherwise address the drawbacks of this arrangement, such as those mentioned above. It is an object of the present invention to overcome or substantially ameliorate the above disadvantages or more generally to provide an improved sander.

DISCLOSURE OF THE INVENTION

According to one aspect of the present invention there is provided a sander comprising:

an abrasive-supporting base having first and second parts, the first part being mounted to an oscillating drive mechanism, a coupling, and wherein the second part is pivotally connected to the first part by the coupling for movement between an extended position in which the second part is substantially aligned with the first part and at least one retracted position, and wherein latching means releasably lock the coupling so as to hold the second part in the extended position.

With the second part in its retracted position either the first part or the second part may be used, while in the extended position both the first and second parts are used together. The invention thus provides a sander that is readily reconfigurable for different applications, without the need to attach and detach base parts. Preferably the first and second parts have respective planar surfaces which are aligned in a substantially coplanar manner in the extended position.

Preferably in the extended position in which the second part is substantially aligned with the first part, respective planar faces on the first and second parts are aligned parallel with one another. The retracted position may comprise one or more retracted positions angularly spaced from the extended position.

Preferably the second part has a planar surface generally symmetrical about a longitudinal centre line and having an outer peripheral edge forming a forward most tip region having two edges joined at an acute angle and a pair of straight lateral edges extending rearwardly from the tip region, the straight lateral edges being substantially parallel.

Preferably the second part has a rearward edge complementary to a forward edge of the first part. Preferably the forward edge of the first part is a pointed tip and the second part has a concave rearward edge in which the pointed tip may be received. Advantageously this arrangement makes it possible to have a point with an acute internal angle on both of the base parts, making both base parts suitable for sanding internal corners.

Preferably the forward most tip region has a thickness conspicuously smaller than the spacing between the two lateral edges. Being relatively thin, the second part may be used to access narrow spaces, as between louvres.

Preferably the first part has a planar surface generally symmetrical about the longitudinal centre line and a forward most tip section having two edges joined at an acute angle.

Preferably the coupling comprises an elongate coupling member defining a pivot axis, the coupling member being received in an aperture in the first part and second part. Preferably the pivot axis is transverse to the longitudinal centre line.

Optionally the latching means may releasably lock the second part in the/each retracted position.

The latching means may comprise a locking member slidably received in the second part, the locking member including two fingers, each finger being received in a respective recess in the first part to lock the coupling against rotation. Preferably the locking member is elongate and received to slide in an aperture in the first part, which aperture extends parallel to the longitudinal centre line, and wherein the fingers are formed on one end of the locking member.

The sander may further comprise a detent to hold the second part in the retracted position. Preferably the detent comprises an interference lobe on the second part, which interference lobe cooperates with a surface on the first part.

In one embodiment the latching means comprises a finger rigidly fixed to the second part, the finger has an longitudinal axis, the coupling member is received in an opening elongated in the longitudinal direction, a resiliently-biased detent member cooperates with a concavity to prevent relative movement of the first and second parts parallel to the axis, and wherein the opening elongated in the longitudinal direction cooperates with the coupling member to allow both rotation about an axis of the coupling member and longitudinal sliding of the second part relative to the first part.

Preferably the coupling member includes an elongate cylindrical face and a flat face, the elongated opening includes a cylindrical portion corresponding to the diameter of the elongate cylindrical face and a relatively narrower mouth portion.

In another embodiment the first and second parts have respective apertures, each aperture having a respective keyway portion therein; the coupling member is received in the apertures for pivotally connecting the first and second parts, the coupling member having axially spaced key portions of complementary shape to the keyway portions, the coupling member being moveable substantially parallel to a pivot axis of the coupling member between a first position and a second position, wherein in the first position the key portions engage the keyway portions to prevent rotation of the coupling and in the second position the key portions are released from one of the keyway portions to allow rotation of the coupling.

BRIEF DESCRIPTION OF THE DRAWINGS

Preferred forms of the present invention will now be described by way of example with reference to the accompanying drawings, wherein.

DESCRIPTION OF THE PREFERRED EMBODIMENTS

Figure 1:
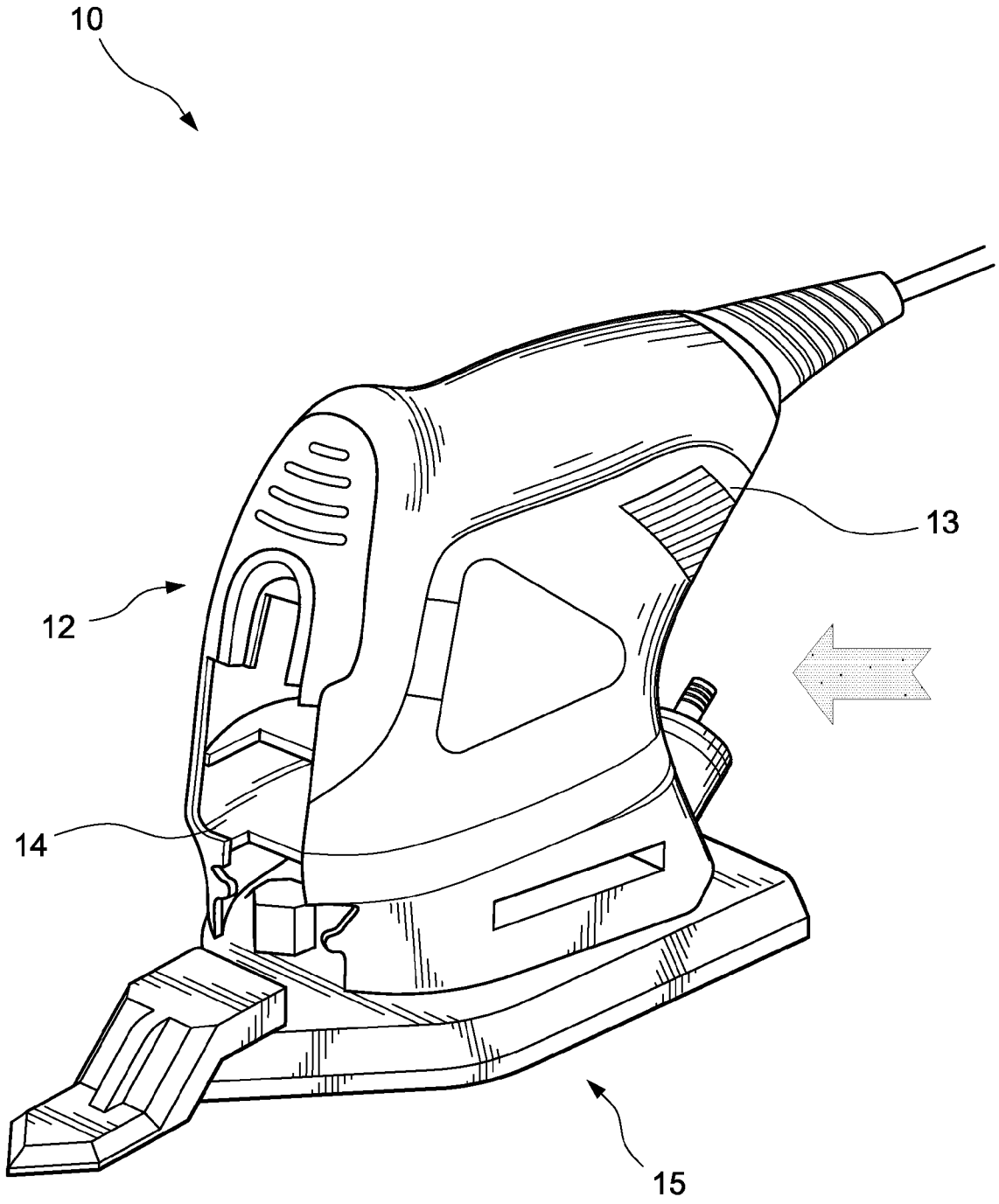
FIG. 1 is a perspective view of a sander according to a first embodiment of the invention.
Figure 2:
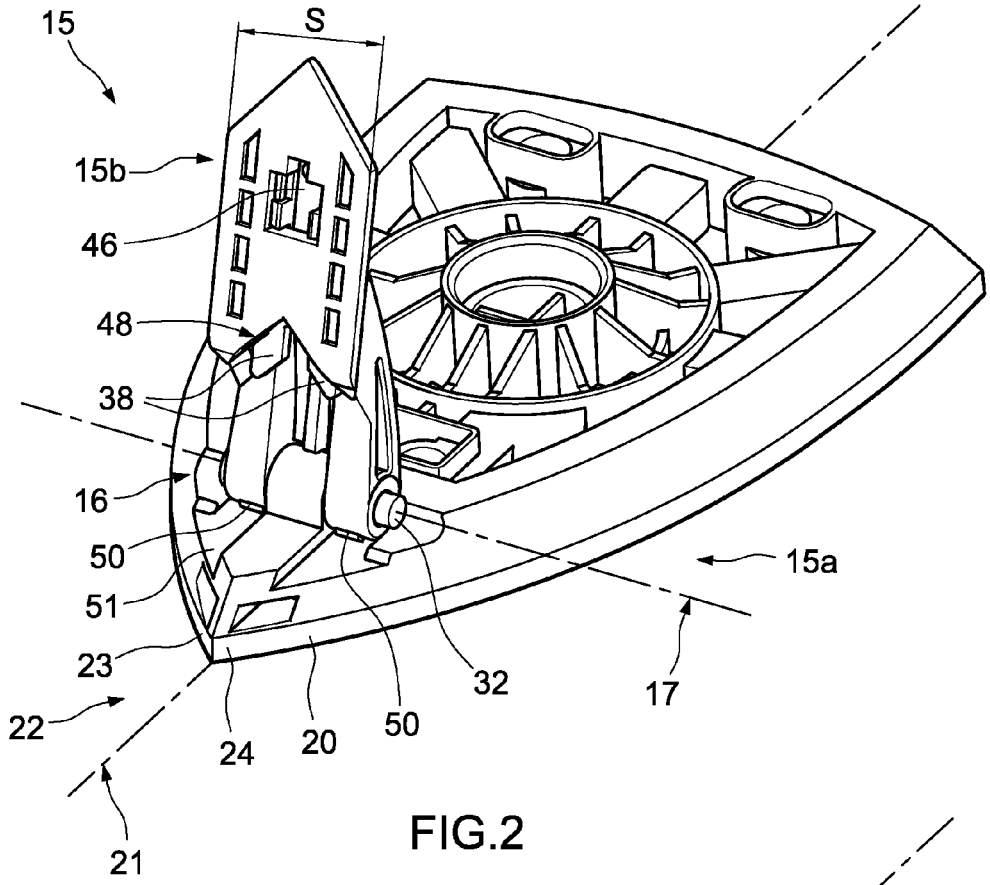
FIGS. 2 and 3 are perspective views of the base member of the sander of FIG. 1 in first and second configurations respectively.
Figure 3:
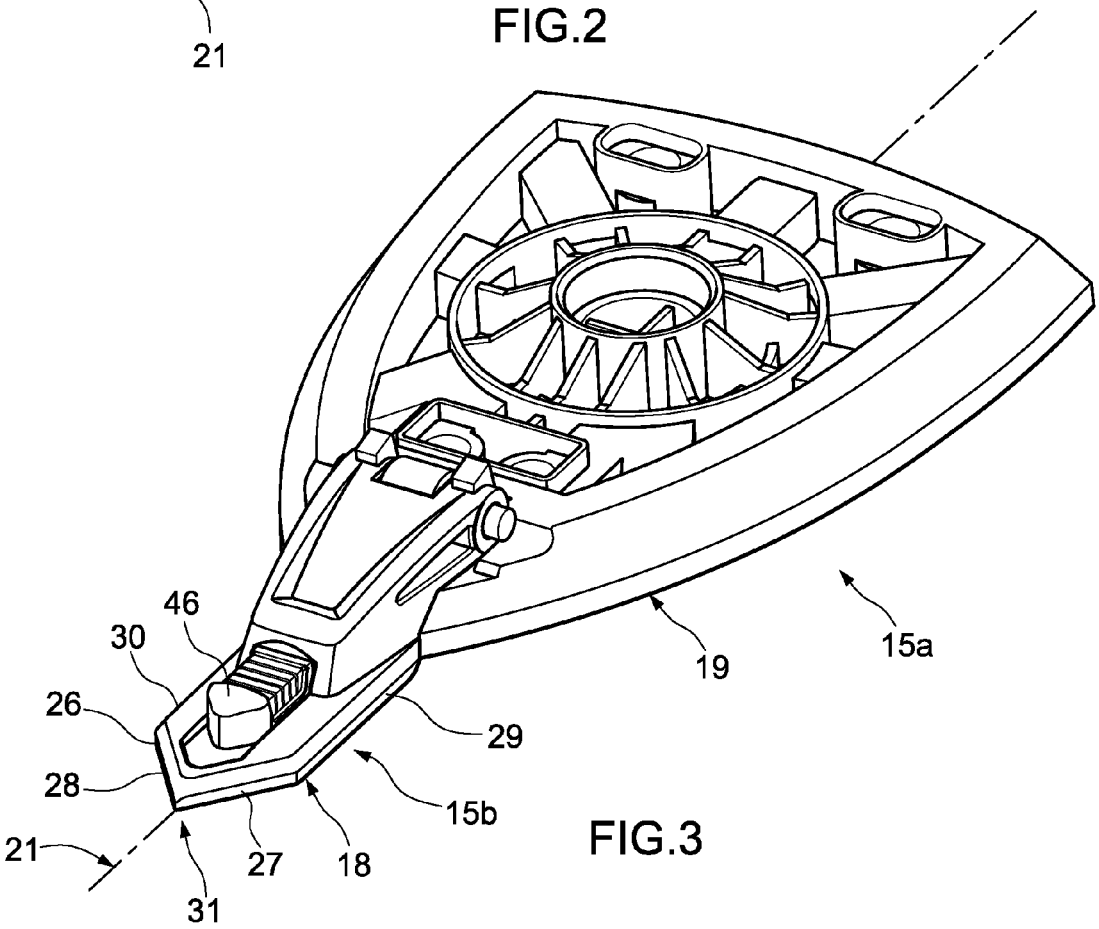
Figure 4:
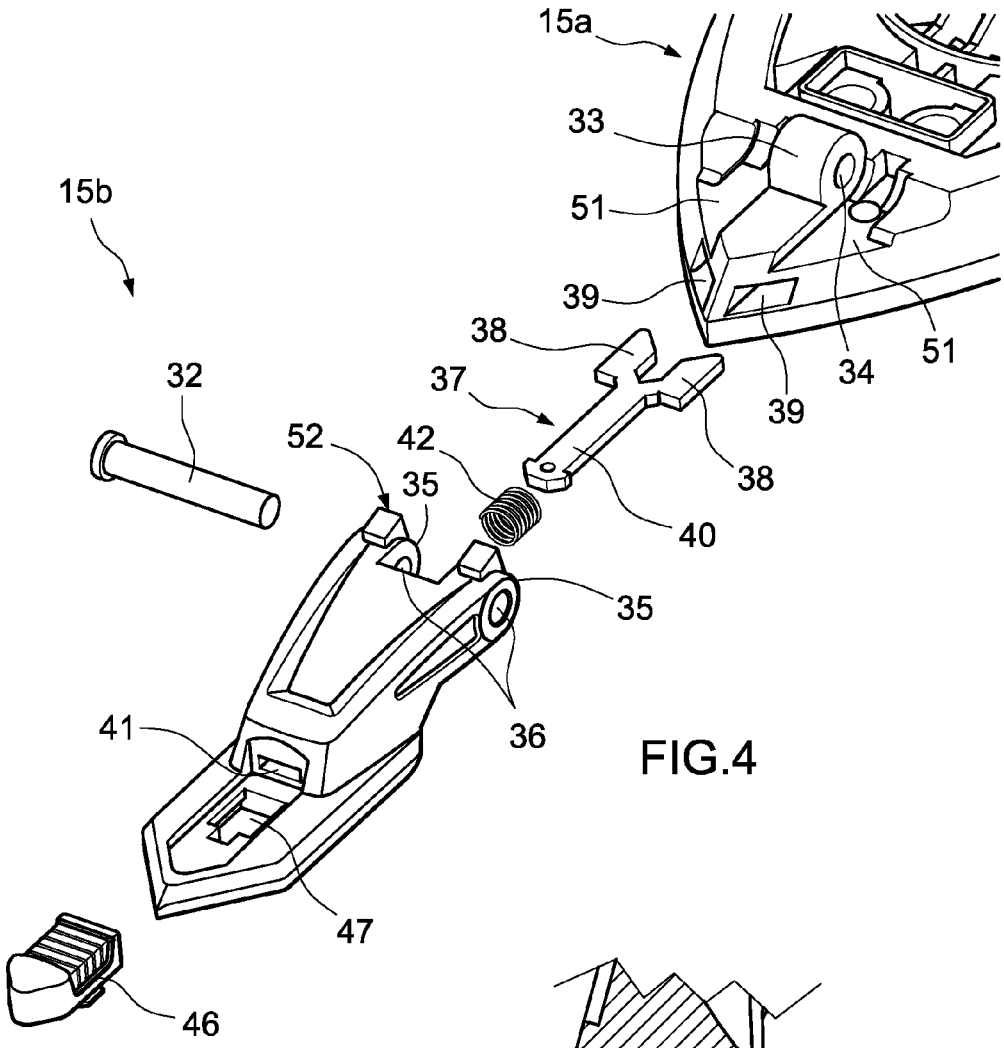
FIG. 4 is an exploded view of the base member of FIGS. 2 and 3.
Figure 5:
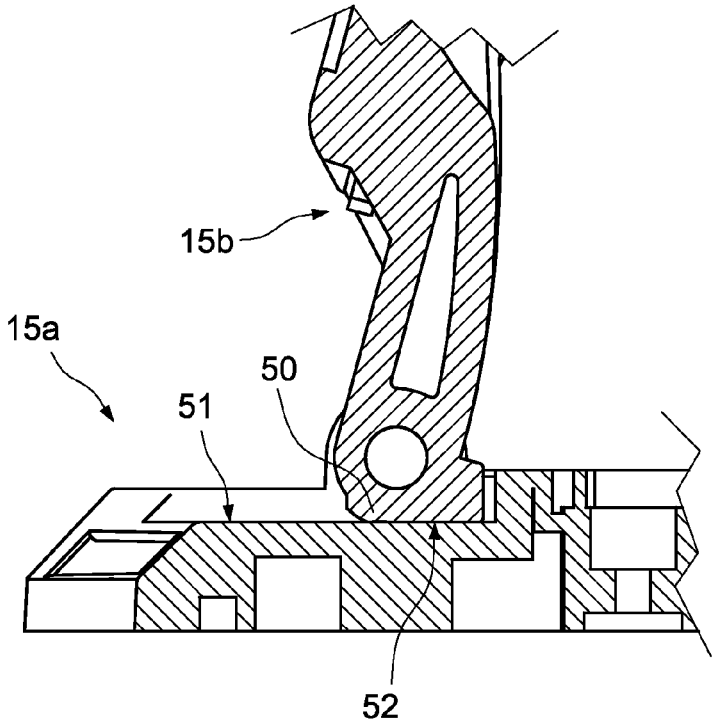
FIG. 5 is a fragmentary section in a longitudinal upright plane through the base member of FIGS. 2 and 3.
Figure 6:
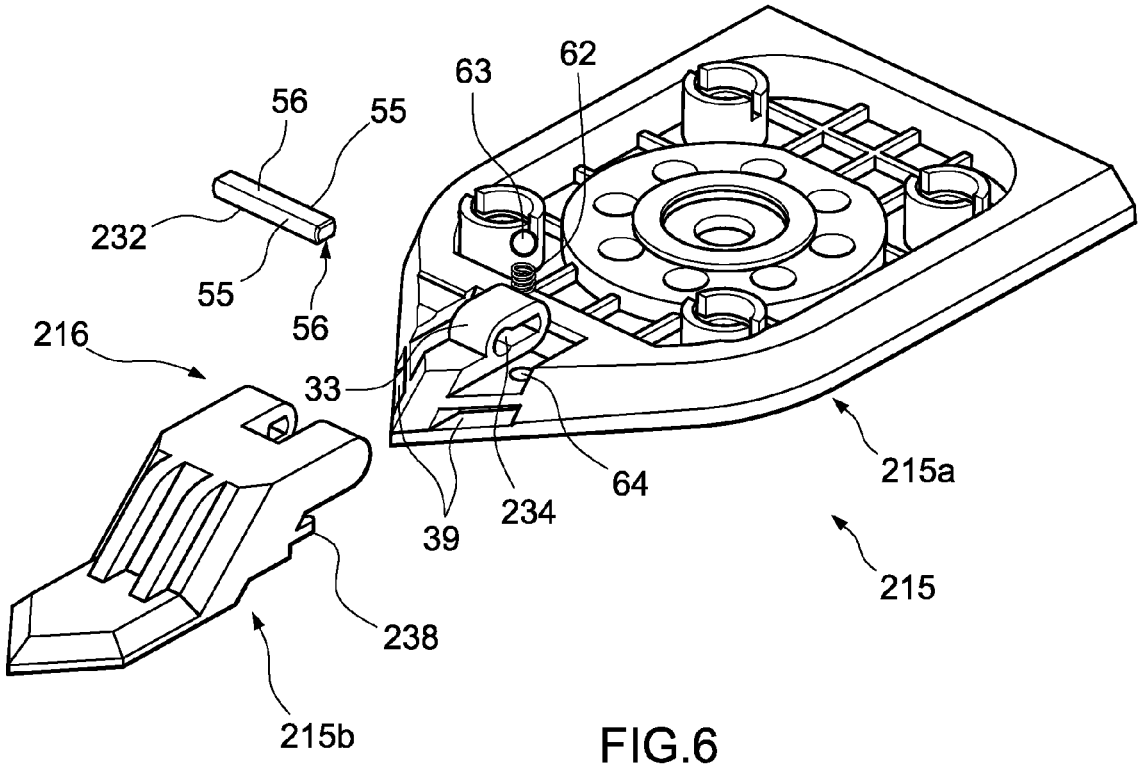
FIG. 6 is an exploded perspective view from above of a base member of a sander according to a second embodiment of the invention.
Figure 7:
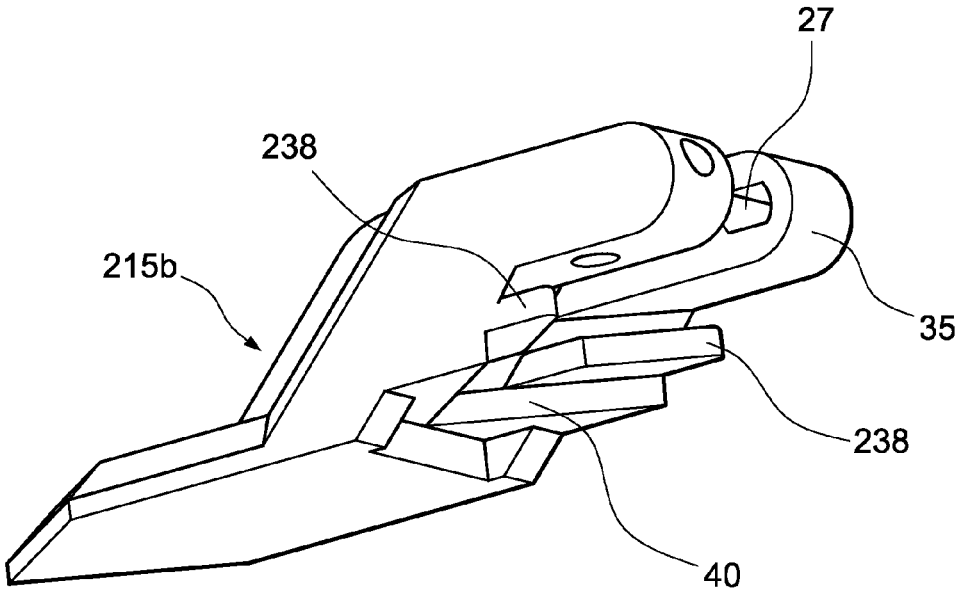
FIG. 7 is a perspective view from below of the second part of the base member of FIG. 6.

The first embodiment of the detail sander 10 of the invention shown in FIGS. 1-5 is utilized for sanding inside corners and other difficult to reach locations. The sander 10 has a body 12, including a grip portion 13 by which it may be held by a user. A recess 14 in is provided in the front of the body 12. The body 12 encloses a motor (not shown) and an oscillatory drive mechanism (not shown). A base member 15 disposed below the body 12 is mounted to the oscillatory drive mechanism for supporting a work member (not shown). The work member may be sandpaper sheet (not shown) or similar abrasive material removably attached to a planar lower face of the first base member 15, as by hook and loop fasteners, or adhesive.

The base member 15 comprises a first part 15*a* directly connected to the oscillatory drive mechanism, and a second part 15*b* connected to the part 15*a* by a coupling 16, such that the first base member 15*a* may pivot relative to the second base member 15*b* about the transverse axis 17. The second part 15*b* pivots between an extended position (shown in FIGS. 1 and 3) and at least one retracted position (shown in FIG. 2). In the extended position a planar lower face 18 of the part 15*b* may be aligned generally coplanar with a planar lower face 19 of the first part 15*a*, to effectively extend the working area of the of the first part 15*a*. In the retracted position, the second part 15*b* is rotated (approximately 110 degrees) and, in plan view lies generally within the periphery 20 of the first part 15*a*. With the second part 15*b* in its retracted position, at least part of the second part 15*b* may be received in the recess 14. By providing first and second parts in this manner, a versatile tool is obtained that is readily re-configurable.

The second part 15*b* is generally symmetrical about a longitudinal centre line 21, with an outer peripheral edge 26 forming a forward most tip region 31 having two straight edges 27, 28 joined at an acute angle. A pair of lateral edges 29, 30 extend rearwardly from the tip region 31 substantially parallel to one another. The second part 15*b* has a concave rearward edge 48 complementary to a pointed forward edge 22 of the first part 15*a*, received their in the extended position. The forward most tip region 31 has a thickness conspicuously smaller than the spacing S between the two lateral edges 29, 30 making it sufficiently thin to access narrow spaces, as between louvres.

The periphery 20 of the first part 15*a* is also generally symmetrical about longitudinal centre line 21. Arcuate lateral edges 23, 24 of the first part 15*a* intersect at an acute angle to form the pointed tip or forward edge 22.

The coupling 16 comprises a pivot 32 having a cylindrical outer surface defining the pivot axis 17. The first part 15*a* includes a centrally positioned projection 33 with a transverse opening 34 therein. The second part 15*b* has a pair of projections 35, each with an opening 36. The pivot 32 extends through the openings 34, 36 and is thus connected in double shear.

Latching means for releasably locking the coupling 16 to hold the second part 15*b* in the extended position, includes a locking member 37 slidably received in an aperture 41 in the second part 15*b*. In the preferred embodiment, the first part 15*a* and second part 15*b* may be moulded polymeric components and the locking member 37 may be made from metal. The locking member 37 is elongate having a bar portion 40 at an outer end which bifurcates to form two fingers 38 at the opposing inner end. The bar portion 40 is received in the opening 41, such that the fit prevents rotation of the locking member 37 but permits sliding. A spring 42 engages the locking member 37 urging the fingers 38 rearwardly. A button 46 is received in an aperture 47 in the second part 15*b* to slide longitudinal. The button 46 is fixed to the outer end of the locking member 37. Parallel apertures 39 are disposed in the first part 15*a* in registration with the fingers 38, and with the fingers 38 received in the apertures 39 the second part 15*b* is latched against rotation. To release the second part 15*b* the button is slid forward, withdrawing the fingers from the apertures 39.

The sander may further comprise a detent to hold the second part 15*b* in the retracted position. The detent may comprise an interference lobe 50 formed on each of the projections 35. The projections 35 further include flats 52 which abut the faces 51 of the first part 15*a* preventing rearward rotation of the second part 15*b*. The interference lobes 50 also abut the face 51 but prevent forward rotation of the second part 15*b*, and thus serve to hold the second part 15*b* in the retracted position. To move the second part 15*b* to the extended position the interference lobes 50 must both go over-centre, and this is permitted by virtue of the inherent resilience of the materials from which the parts are made and of the construction, allowing the requisite elastic deformation each time this occurs.

FIGS. 6-9 illustrate a second embodiment of the invention, and like numbers are used to refer to like components. The first part 215*a* and the second part 215*b* of the base member 215 are mutually connected for rotation by a coupling 216 including a bar 232 of an elongate cylindrical form, with coaxial semi-cylindrical faces 55 separated by opposing, flat faces 56. The bar 232 defines the transverse pivot axis 17 and its opposing ends are received in complementary holes 57 in the projections 35, thereby preventing rotation of the bar relative to the second part 215*b*. In the extended position a planar lower face 18 of the part 215*b* may be aligned generally parallel with a planar lower face 19 of the first part 215*a*. The coupling 216 includes a transverse opening 234 in the projection 33. The opening 234 is elongated in the longitudinal direction, having at its outer end a cylindrical portion 59 corresponding to the diameter of the cylindrical faces 55, and at its inner end a narrow mouth 60 of dimension corresponding to the spacing between the flat faces 56. The fingers 238 are elongated in the direction of the longitudinal axis 21 and are integral with the second part 215*b*. A spring 62 and ball 63 are disposed in a recess 64 in the first part 215*a*, such that the spring urges the ball 63 outwardly.

Figure 8A:
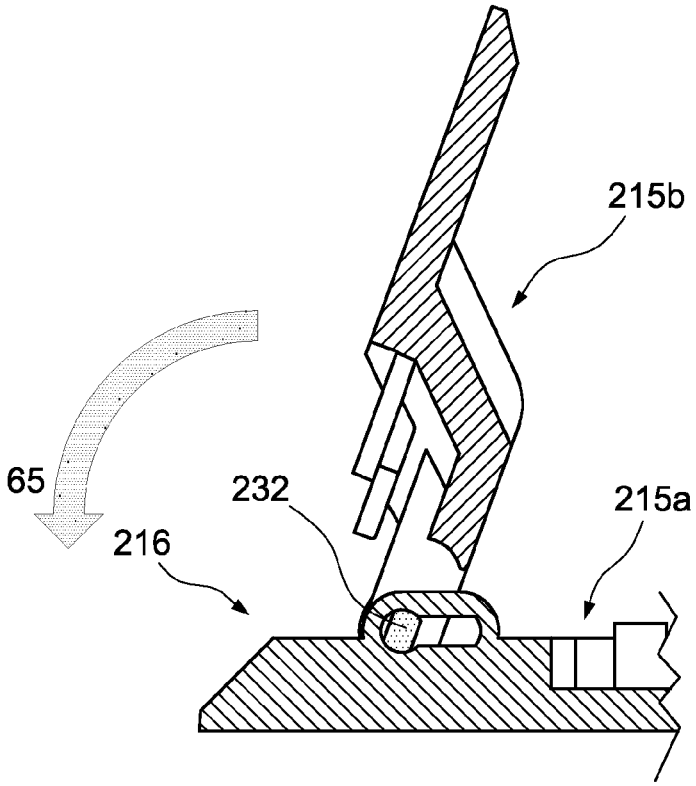
FIGS. 8*a*, 8*b* and 8*c* are fragmentary side views showing the second part of the base member of FIG. 6 in retracted, intermediate and extended positions respectively.
Figure 8B:
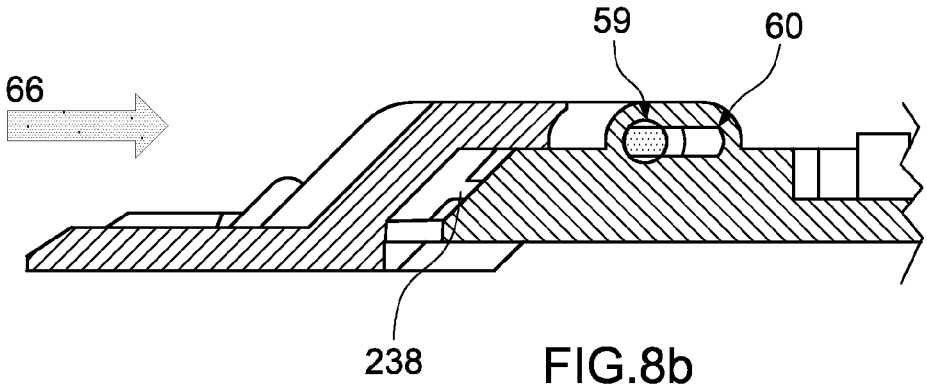
Figure 8C:
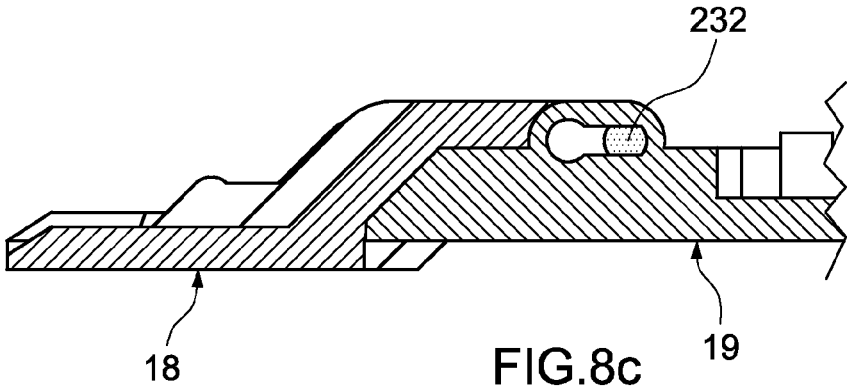

FIGS. 8*a*-8*c* illustrate the turn-and-push operation of the coupling 216. With the second part 215*b* in its retracted position (FIG. 8*a*) the bar 232 is received in the cylindrical portion 59 and is thus able to turn forward in direction 65 until the second part 215*b* abuts the first part 215*a* (FIG. 8*b*). Next, the second part 215*b* may be pushed rearwardly in direction 66, this rearward movement enters the bar 232 into the narrow mouth 60, while the fingers 238 are simultaneously entered in the recesses 39 (FIG. 8*c*). The coupling 216 and the fingers 238/recesses 39 thereby cooperate to prevent rotation of the second part 215*b* in the extended position.

Figure 9:
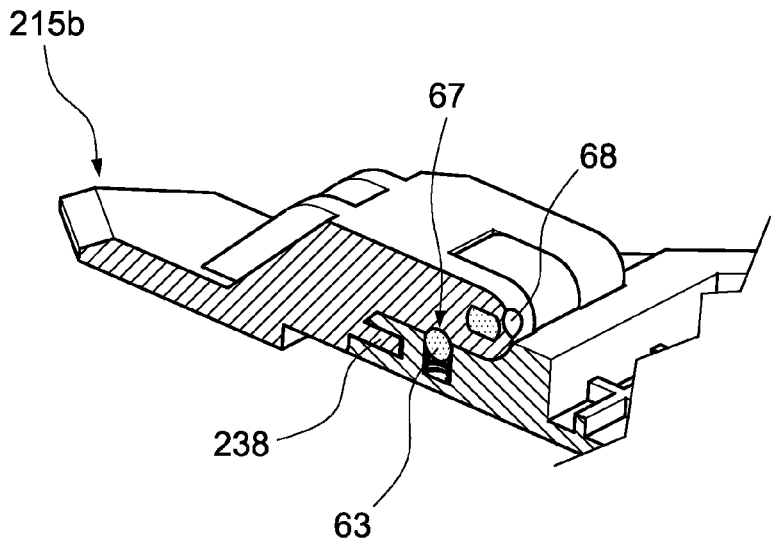
FIG. 9 is a fragmentary sectional view in an upright longitudinal plane of the second part of the base member of FIG. 6.
Figure 10:
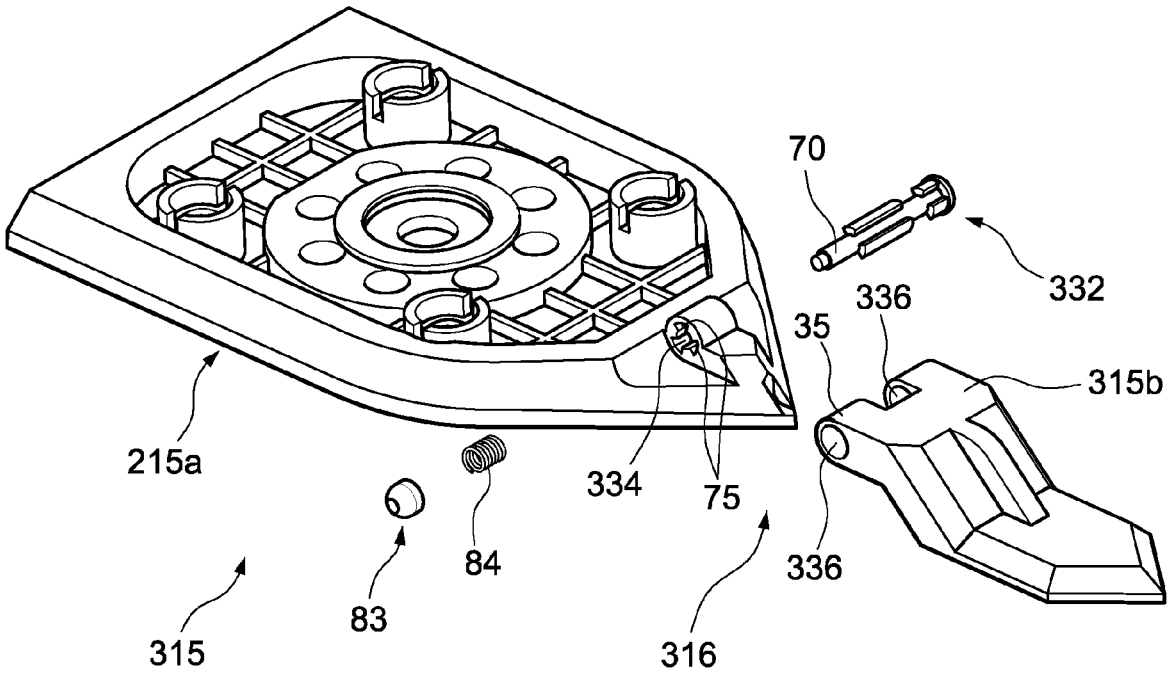
FIG. 10 is an exploded perspective view from above of a base member of a sander according to a third embodiment of the invention.
Figure 11:
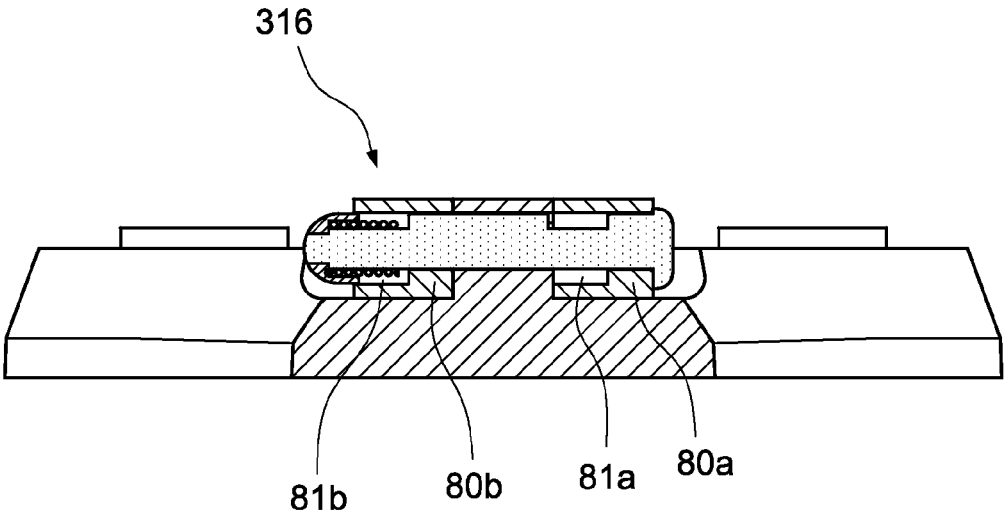
FIGS. 11 and 12 are transverse sectional views in an upright plane showing the coupling between the parts comprising the base member of FIG. 10 in locked and released positions respectively.
Figure 12:
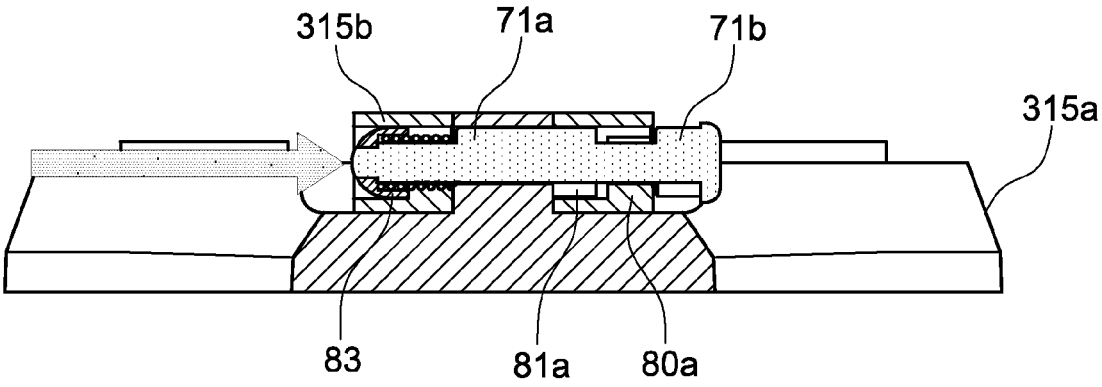
Figure 13:
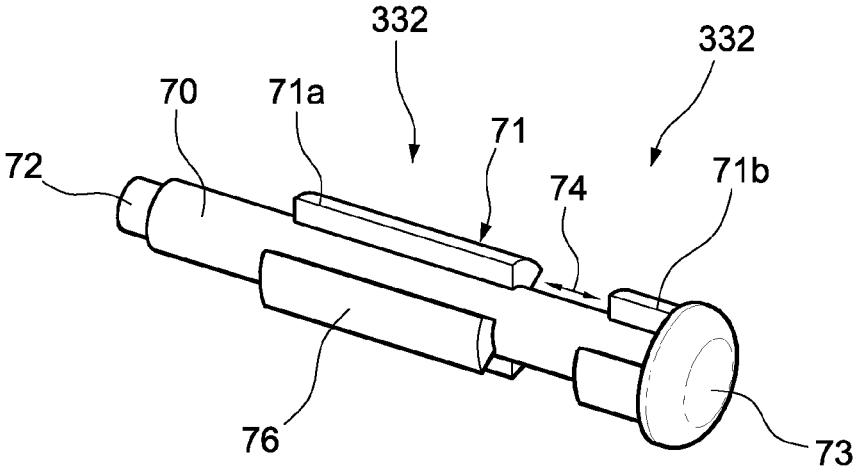
FIG. 13 is a perspective view of a shaft connecting the parts of the base member of FIG. 10.

As shown in FIG. 9, the second part 215*b* includes a first recess 67 and a second recess 68. The ball 67 is partially received in the first recess 67 to hold the second part 215*b* in the extended position, and is likewise partially received in the first recess 68 to hold the second part 215*b* in the retracted position.

A third embodiment of the invention is shown in FIGS. 10-14. The first part 315*a* and the second part 315*b* are mutually connected for rotation by a coupling 316 including a coupling member in the form of a shaft 332. The shaft 332 has an elongate, cylindrical section 70 from which three equally circumferentially spaced key portions 71 project. The key portions 71 are integral with the shaft 332 and extend axially from a head 73 formed on one end of the shaft 332 to finish at a first intermediate position between the head 73 and opposing end 72. Each key portion 71 has a partially cylindrical face 76 coaxial with the surface 70. A discontinuity 74 positioned at a second intermediate position between the head 73 and opposing end 72 divides the key portions 71 into inner portions 71*a* and outer portions 71*b*.

The coupling 316 includes a transverse opening 334 in the projection 33 which includes three equally circumferentially spaced keyway portions 75, for receiving the portions 71, thereby preventing rotation of the shaft 332 relative to the first part 315*a*.

The head 73 of the shaft 332 is disposed on the left side of the sander. Opposing ends of the spring 84 bear against the button 83 and the second part 315*b* thereby urging the shaft 332 toward the right. The apertures 336 in the projections 35 are of like form, comprising axially spaced portions 80*a*, 80*b* and 81*a*, 81*b* on their left and right sides respectively. The portions 80*a*, 80*b* have like form to the opening 334 with keyway portions 75 for receiving the key portions 71. The portions 81*a*, 81*b* comprise cylindrical recesses. A button 83 is fixed to the end 72 of the shaft, and disposed on the right side of the sander at least partially within the cylindrical portion 81*b* of the opening 336.

With the second part 315*b* in its extended position and the shaft 332 in its locked position (FIG. 11), the inner key portions 71*a* are received in the portion 81*b*, and the outer key portions 71*b* are received in the portion 80*a*, the key portions and keyway portions thereby cooperating to lock the second part 315*b* against rotation about the shaft 332.

The shaft 332 defines the transverse pivot axis 17 and is moved to its unlocked position (FIG. 12) by pressing the button 83. In this unlocked position the inner key portions 71*a* are withdrawn from the portion 81*b*, and the outer key portions 71*b* are withdrawn from the portion 80*a*. At the same time the inner key portions 71*a* are entered into the cylindrical portion 81*a*. With the key portions and keyway portions connecting the shaft 332 and second part 315*b* thereby released, and the outer faces 76 and the button 83 engaged in the cylindrical faces 81*a*, 81*b* the second part 315*b* is then free to rotate to its retracted position.

Aspects of the present invention have been described by way of example only and it should be appreciated that modifications and additions may be made thereto without departing from the scope thereof.

The invention claimed is:

1. A sander comprising:

an abrasive-supporting base having a first part with a first lower face and a second part with a second lower face, the first part being mounted to an oscillating drive mechanism, a coupling, and wherein the second part is pivotally connected to the first part by the coupling for movement between an extended position in which the second lower face is substantially coplanar with the first lower face and at least one retracted position in which the second lower face is not coplanar with the first lower face, and wherein latching means releasably lock the coupling so as to hold the second part in the extended position.

2. The sander of claim 1, wherein the second lower face is generally symmetrical about a longitudinal center line and has an outer peripheral edge forming a forward most tip region having two edges joined at an acute angle and a pair of straight lateral edges extending rearwardly from the tip region, the straight lateral edges being substantially parallel.

3. The sander of claim 2, wherein the forward most tip region has a thickness conspicuously smaller than a spacing between the two lateral edges.

4. The sander of claim 2, wherein the first lower face is generally symmetrical about the longitudinal center line and has a forward most tip section having two edges joined at an acute angle.

5. The sander of claim 2, wherein the latching means comprise a locking member slidably received in the second part, the locking member preferably including two fingers, each finger being received in a respective recess in the first part to lock the coupling against rotation.

6. The sander of claim 5, wherein the locking member is elongate and received to slide in an aperture in the second part, which aperture extends parallel to a longitudinal center line about which the second lower face is generally symmetrical, and wherein the fingers are formed on one end of the locking member.

7. The sander of claim 6, further comprising a detent to hold the second part in the retracted position.

8. The sander of claim 7, wherein the detent comprises an interference lobe on the second part, which interference lobe cooperates with a surface on the first part.

9. The sander of claim 1, wherein the coupling comprises an elongate coupling member defining a pivot axis, the coupling member being received in an aperture in the first part and the second part.

10. The sander of claim 9, wherein the pivot axis is transverse.

11. The sander of claim 1, wherein the second part has a rearward edge complementary to a forward edge of the first part.

12. The sander of claim 11, wherein the forward edge of the first part is a pointed tip and the second part has a concave rearward edge in which the pointed tip may be received.

13. The sander of claim 1, wherein the latching means comprises a finger rigidly fixed to the second part, the finger has an longitudinal axis, the coupling member is received in an opening elongated in the longitudinal direction, a resiliently-biased detent member cooperates with a concavity to prevent relative movement of the first and second parts parallel to the axis, and wherein the opening elongated in the longitudinal direction cooperates with the coupling member to allow both rotation about an axis of the coupling member and longitudinal sliding of the second part relative to the first part.

14. The sander of claim 13, wherein the coupling member includes an elongate cylindrical face and a flat face, the elongated opening includes a cylindrical portion corresponding to the diameter of the elongate cylindrical face and a relatively narrower mouth portion.

15. The sander of claim 1, wherein the first and second parts have respective apertures, each aperture having a respective keyway portion therein; the coupling member is received in the apertures for pivotally connecting the first and second parts, the coupling member having axially spaced key portions of complementary shape to the keyway portions, the coupling member being moveable substantially parallel to a pivot axis of the coupling member between a first position and a second position, wherein in the first position the key portions engage the keyway portions to prevent rotation of the coupling and in the second position the key portions are released from one of the keyway portions to allow rotation of the coupling.

* * * * *